United States Patent [19]

Deng

[11] Patent Number: 4,970,732

[45] Date of Patent: Nov. 20, 1990

[54] CONCEALED TOILET BOWL

[76] Inventor: Tay C. Deng, 17, Lane 5 Kuang Ming, Yung-An Shiang, Kaohsiung Hsien, Taiwan

[21] Appl. No.: 426,120

[22] Filed: Oct. 24, 1989

[51] Int. Cl.[5] ..... E03D 11/12

[52] U.S. Cl. ..... 4/312

[58] Field of Search ..... 4/307, 312, 233

[56] References Cited

U.S. PATENT DOCUMENTS

| | | | |
|---|---|---|---|
| 2,794,988 | 6/1957 | Colnna | 4/412 |
| 3,436,764 | 4/1969 | Colonna | 4/312 |
| 4,094,019 | 6/1978 | Moore et al. | 4/312 |
| 4,797,959 | 1/1989 | Decaux | 4/312 X |
| 4,799,272 | 1/1989 | Horng | 4/312 |

*Primary Examiner*—Charles E. Phillips

*Attorney, Agent, or Firm*—Fleit, Jacobson, Cohn, Price, Holman & Stern

[57] ABSTRACT

A concealed toilet bowl contained in a base embedded in a wall, comprising a driving mechanism to move the toilet bowl out of the case for use or into the case for concealing same, a blower, a water tank and pipes for flushing water into the toilet bowl and exhausting it out.

3 Claims, 6 Drawing Sheets

CONCEALED TOILET BOWL

BACKGROUND OF THE INVENTION

A toilet bowl is usually installed steady and immovable in a toilet near a corner, and a toilet cannot always occupy a large space so that a toilet bowl is often felt to make the toilet narrow or crowded. Besides, a toilet is also often used as a bathroom, so the seat of the toilet bowl is often too wet to be sit on, quite inconvenient for use.

SUMMARY OF THE INVENTION

This invention has been aimed to furnish a concealed toilet bowl, which can be concealed in a recess of a wall when it is not in use, but can be moved out from the recess when it is needed for use, saving the space of a toilet.

The concealed toilet bowl in accordance with the present invention comprises a case with a removable lid installed in a recess of a wall, a toilet bowl, a water tank, a driving mechanism, and a blower, separately mounted in divided compartments in the case.

The toilet bowl has its both lower side walls, right and left, so assembled with a pivotal rod that the toilet bowl can revolve for 90° with the pivotal rod as a pivot so that the toilet bowl can be moved out of the case for use from the vertical concealed position to the horizontal position. The pivotal rod is sustained at both ends in both the vertical side walls of the case by ball bearings, which support at right side a shaft having its inner end inserting in one end of the pivotal rod and the other end fixed with a gear wheel revolved by the driving mechanism and at the left side a cylinder inserted in by an elbow fitting having one end joined with a water pipe from the water tank and the other end joined with a through hole in the pivotal rod. The through hole in the rod communicated with a flowing-in pipe joined with the toilet bowl so that the water from the tank can be flushed in the toilet bowl. The shaft is combined with the pivotal rod by a long bolt penetrating lengthwise through the center of the shaft and screwing in the rod. Additionally, the toilet bowl is provided with a ball bearing separately at both side walls, and the ball bearings fit and move in curved slots in both the vertical side walls of the case so as to help and limit the revolving action of the toilet bowl for 90° when the toilet bowl is revolved by the pivotal rod rotated by the gear wheel on it driven by the driving mechanism. Then the toilet bowl stays vertical when in the concealed position and becomes horizontal when in the moved-out position.

Besides, the toilet bowl has its through hole communicating with a Z-shaped pipe joined with a waste pipe, which inserts in a valve fixed in the middle section of the pivotal rod. The valve has an opening for the waste pipe to move therein along with the revolution of the toilet bowl so that the flushed water can flow down orderly through the through hole of the toilet bowl, the Z-shaped pipe, the waste pipe and finally through an exit at the bottom of the valve.

BRIEF DESCRIPTION OF THE DRAWINGS

This invention will now be described in detail with reference to accompanying drawings wherein.

DETAILED DESCRIPTION OF THE INVENTION

Figure 1:
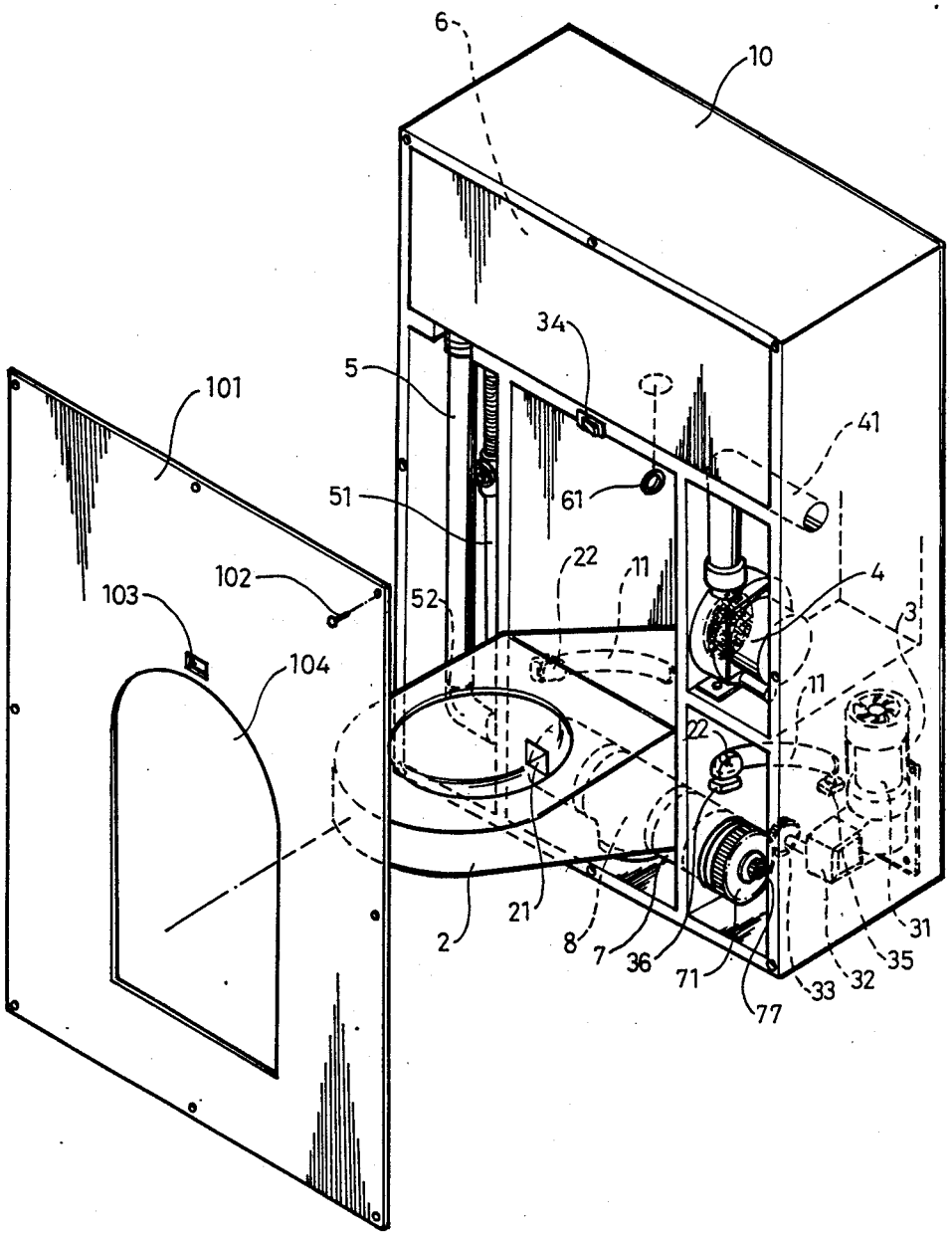
FIG. 1 is a perspective view of the concealed toilet bowl in accordance with the present invention.

At first, the concealed toilet bowl according to the present invention, as shown in FIG. 1, comprises a case 10 for containing all the parts therein, and the case 10 can be installed in a recess of a wall. The case 10 is provided with a lid 101 removably assembled with the case 10 by means of bolts 102. The lid 101 is provided with a switch hole 103 and a toilet bowl opening 104, and the interior of the case 10 can be seen to be divided into a plurality of compartments for installing a toilet bowl 2, a driving mechanism 3, a blower 4, a pipe 5 and a water tank 6.

Figure 2:
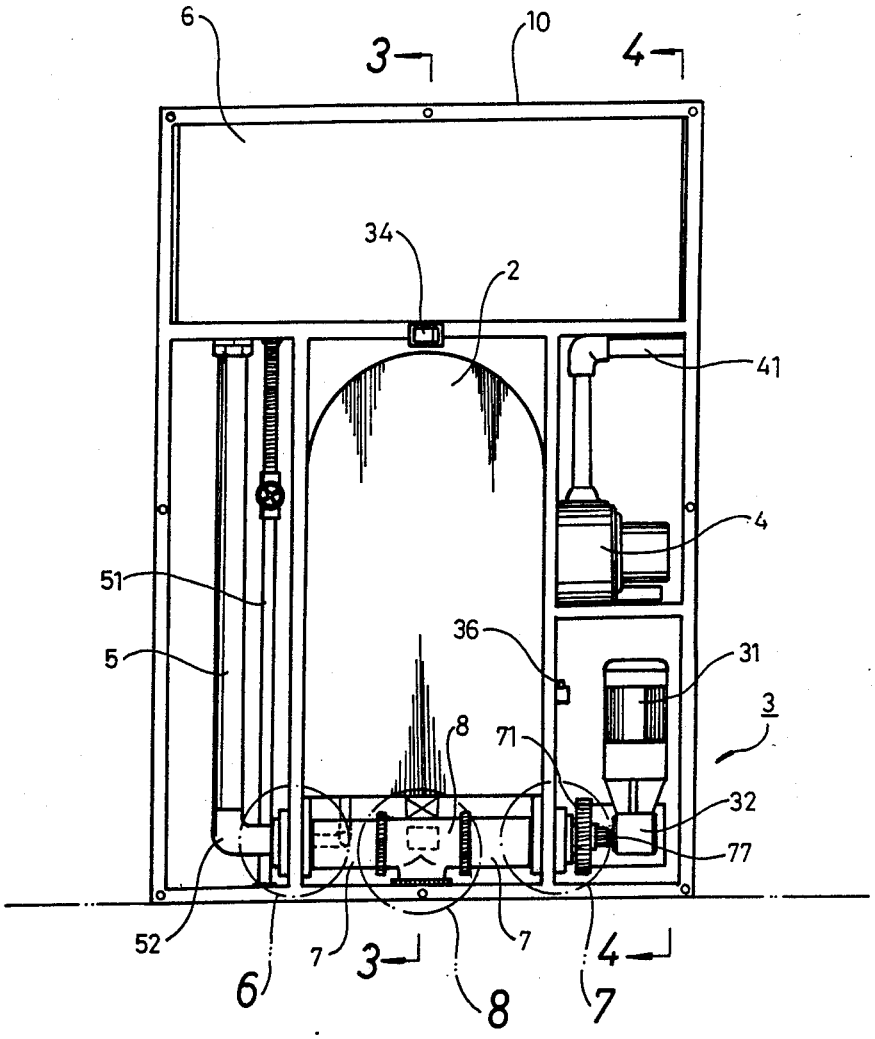
FIG. 2 is a front view of the concealed toilet bowl with the face plate removed in accordance with the present invention.
Figure 4:
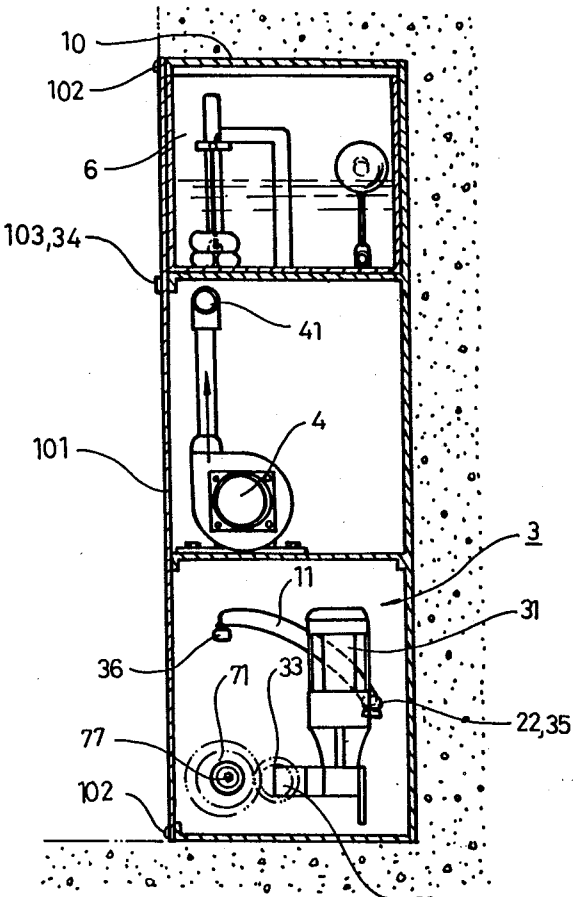
FIG. 4 is a cross-sectional view taken along line 4—4 of FIG. 2.
Figure 3:
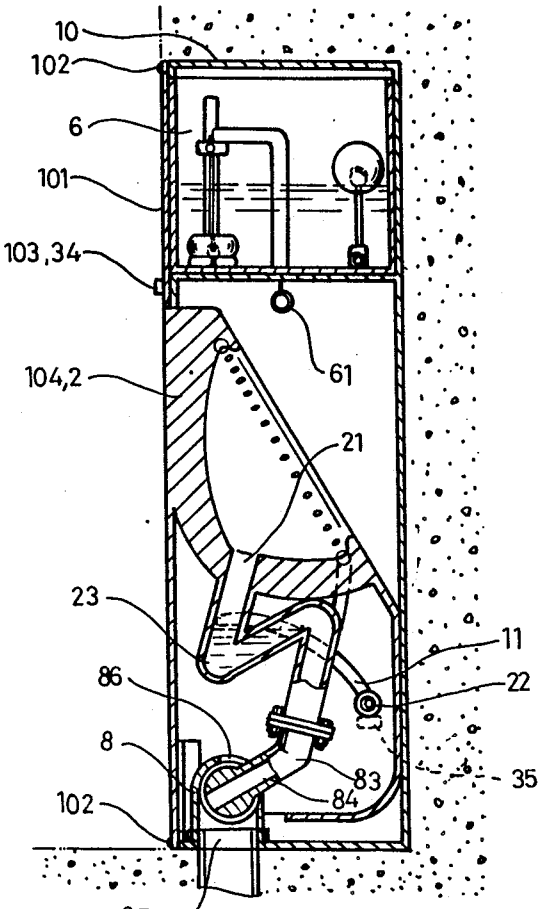
FIG. 3 is a cross-sectional view taken along line 3—3 of FIG. 2.
Figure 5:
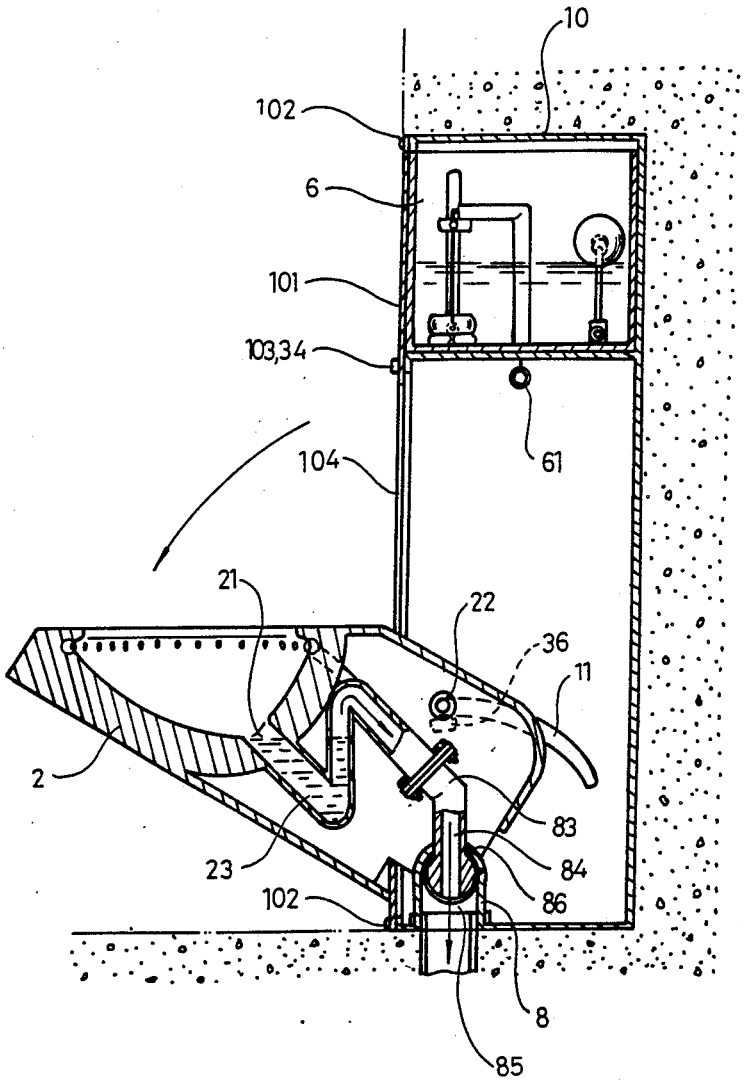
FIG. 5 is a side cross-sectional view of the concealed toilet bowl moved out in accordance with the present invention.

The toilet bowl 2 shown in FIGS. 1, 2 and 3 comprises a round pivotal rod 7 at the lower section, and can revolve for 90° with the pivotal rod 7 as a pivot. Besides, the toilet bowl 2 comprises two ball bearing 22 respectively set at both side walls sticking in a curved slot 11 in the case side walls adjacent to the side walls of the toilet bowl 2 so as to enable the toilet bowl 2 to revolve in or out of the case 10 for 90°. Besides, a gear wheel 71 is provided at the right end of the pivotal rod 7, engaged with and driven by a gear wheel 33 rotated by a motor 31 comprised in the driving mechanism 3. Therefore, the toilet bowl 2 can be moved by the motor 31, when the motor 31 rotates, by the control of a switch 34 which can function to let the motor 31 turn clockwise or anti-clockwise so that the ball bearings 22 can be moved from one end to the other end or reversely of the slots 11 in the case 2 and then touches a limit switch 35 as shown in FIG. 4 or another limit switch 36 as shown in FIG. 5 to stop the motor 31. When the toilet bowl 2 is moved out for use, a blower 4 is also turned on electrically to suck bad odor out of an exhausting pipe 41 preferably joined with a pipe buried in a wall and led to the outside. When the ball bearings 22 touch the limit switch 35 in moving-in action of the toilet bowl 2 after use, the blower 4 is turned off electrically too. The water pipe 5 is fixed between the water tank 6 and the toilet bowl 2 and the water in the water tank 6 can be flushed into the toilet bowl 2 with a pull ring 61 pulled down if needed. The water in the tank 6 can be replenished through a flowing-in pipe 51 joined with a water pipe buried in a wall.

Next, referring to FIG. 3, the ball bearings 22 stay at the lower ends of the slots 11 when the toilet bowl 2 is concealed in the case 10, and the toilet bowl 2 comprises a Z-shaped pipe 23 having its up end communicating with the through hole 21 and the lower end joined with a waste pipe 83 so that some water can be always stored in the Z-shaped pipe 23 and thereby bad odor can be hampered from spreading upward.

Figure 6:
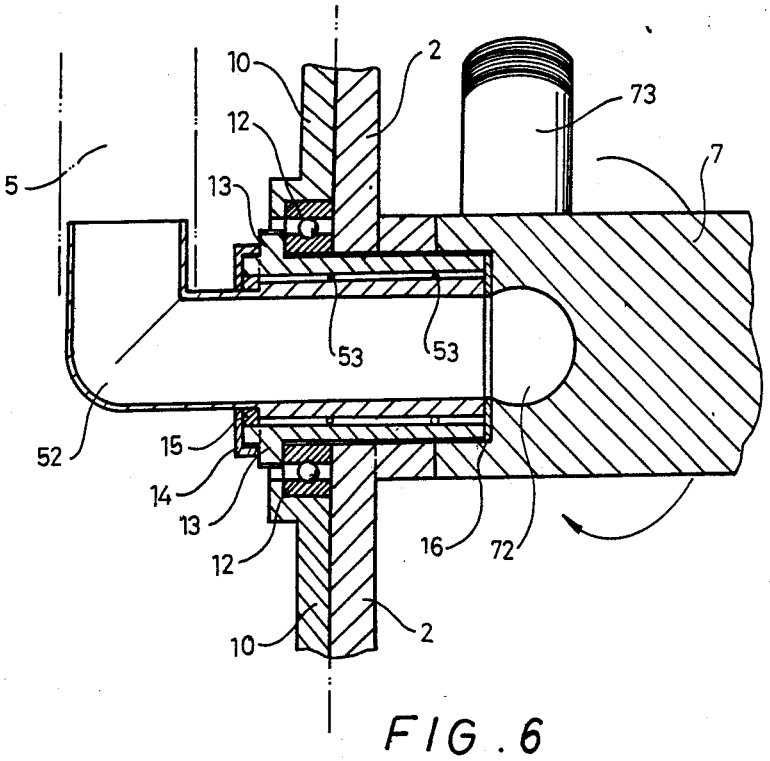
FIG. 6 is an enlarged cross-sectional view of the section 6 on FIG. 2.

Referring to FIGS. 2 and 6, the pivotal rod 7 is combined with the toilet bowl 2, having its both ends sticking in the side walls of the toilet bowl 2 by means of projections and holes so that the toilet bowl 2 can revolve along with the pivotal rod 7 synchroneously. The pivotal rod 7 is provided with a through hole 72 communicating with a pipe 73, through which the water coming from the pipe 5 and the elbow 53 can be flushed in the toilet bowl 2, as the water in the tank 6 first flows through the pipe 5 having its bottom end joined with an elbow fitting 52, which has the horizontal section tightly bound with an anti-leak gasket 53 and joined with and going through a cylinder 13. The cylinder 13 is assembled with a ball bearing 12 fixed in the side wall of the case 10, provided with male thread for screwing with the pivotal rod 7, the wall of the toilet bowl 2 and a nut 14 at the same time. An anti-leak gasket 15 or 16 is respectively provided between the nut 14 and the elbow fitting or between the end of the elbow fitting 52 and the pivotal rod 7 such that the pivotal rod can revolve without water leaking therefrom.

Figure 7:
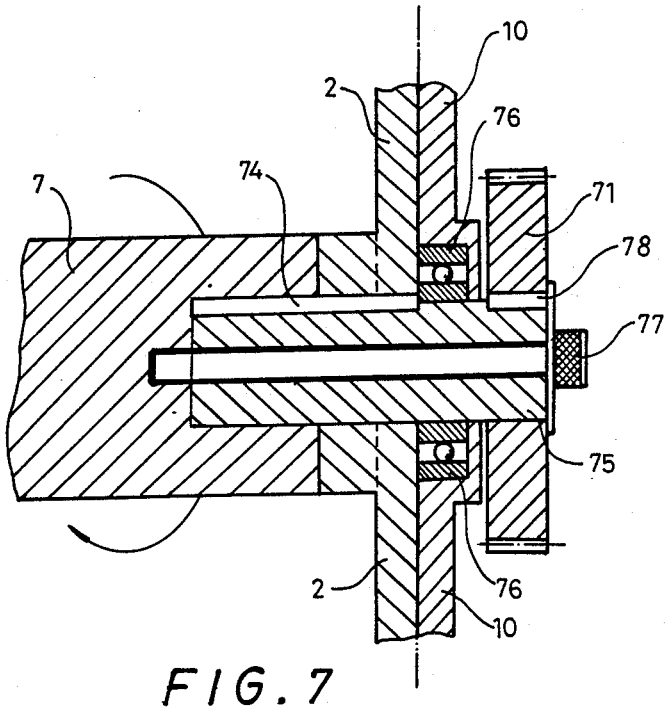
FIG. 7 is an enlarged cross-sectional view of the section 7 on FIG. 2.

Now, referring to FIG. 7, the right end of the pivotal rod 7 and the side wall of the toilet bowl 2 are combined together by a projection 74 and a shaft 75 sustained by a ball bearing 76 fixed in the side wall of the case 10 adjacent to the side wall of the toilet bowl 2 and a gear wheel 71 mounted around said shaft 75. Then the shaft 75 is steadfastly assembled with the pivotal rod 7 by a bolt 77 penetrating the center of the shaft 75 and screwing in the center of the pivotal rod 7, and the gear wheel 71 and the shaft 75 are immovably connected by means of a projection 78 so that the revolution of the gear wheel 71 can cause the pivotal rod 7 and the toilet bowl 2 revolve all together synchroneously.

Figure 8:
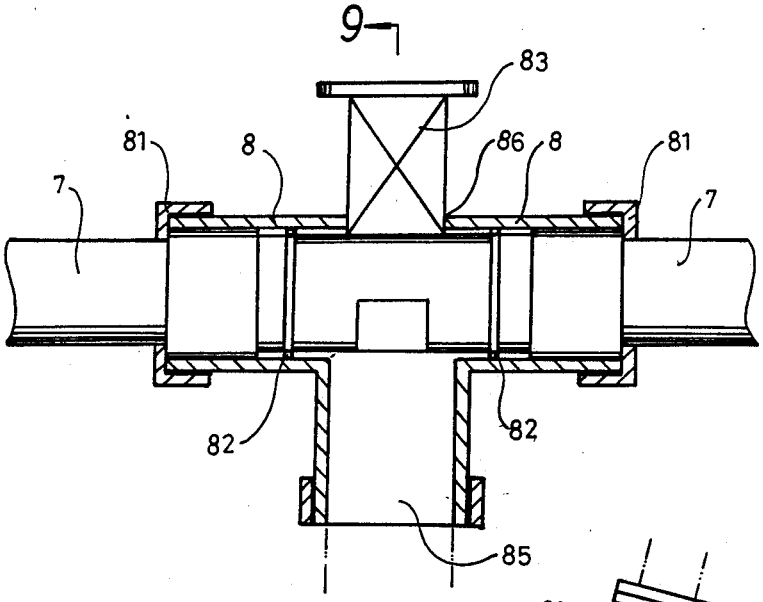
FIG. 8 is an enlarged cross-sectional view of the section 8 on FIG. 2.

Besides, a valve 8 is provided in the middle section of the pipe 7 having both ends closed and united with the pivotal rod 7 with caps 81 as shown in FIG. 8. The valve 8 is also united with one end of the waste pipe 83 vertically, whose other end is joined with the Z-shaped pipe 23. An anti-leak gasket 82 is respectively fixed at both ends where the waste pipe 83 inserts in the valve 8 to prevent water from leaking out of the caps 81. The waste pipe 83 has a through hole 84 for the water in the toilet bowl 2 to flow through and fall down to the exit 85 at the bottom of the valve 8.

Figure 9:
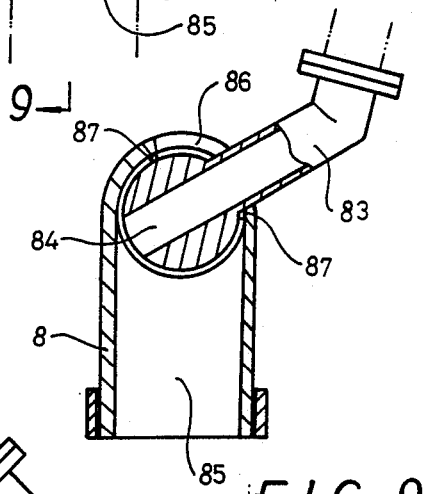
FIG. 9 is a cross-sectional view taken along line 9—9 of FIG. 8.
Figure 10:
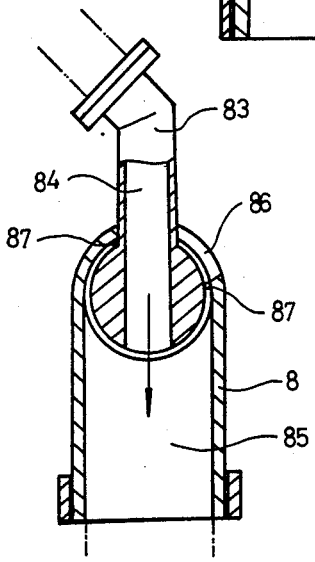
FIG. 10 is an enlarged cross-sectional view of the section 9 on FIG. 8 when the toilet bowl is moved out for use.

As shown in FIGS. 9 and 10, to valve 8 is provided with an opening 86 for the waste pipe 83 to move along with the close-stool 2, and the opening 86 is circumferentially surrounded by an anti-leak gasket 87 to prevent water from leaking therefrom.

In general, this toilet bowl 2 does not occupy much room, possible to be electrically revolved to be hidden in a wall when not in use and to be revolved out by the driving mechanism 3 for use by pushing the switch 34 and be flushed with water after use pulling the ring 61. The water coming through the pipe 5 can flush into the toilet bowl 2 mingling with the waste and is exhausted through the waste pipe 83 steadied by the valve 8. Therefore, it is very convenient, possible to be installed at some other proper place than a toilet if wanted.

What is claimed is:

1. A concealed toilet bowl contained in a case installed in a recess of a wall, said case divided into a plurality of compartments for mounting the bowl, a driving mechanism, a blower, pipe lines and a water tank, said driving mechanism having a motor to be started to revolve clockwise or anti-clockwise or stopped by a switch, said motor used to revolve a gear wheel fixed on a pivotal rod, said gear wheel revolving said pivotal rod and said toilet bowl at the same time, said toilet bowl having side walls assembled fast with respective ends of said pivotal rod so that said toilet bowl can revolve for 90° along with said pivotal rod as a pivot, each side wall of the toilet bowl also provided with a ball bearing movably fitted in a curved slot in a respective wall of the case adjacent the respective side wall of the toilet bowl such that said ball bearings can be moved from one end to the other end of the slots or reversely and touch a limit switch to stop the driving mechanism and thereby said bowl can be revolved for 90° to be concealed in the case or to move out of the case for use.

2. The concealed toilet bowl as claimed in claim 1, wherein the water in the water tank is guided by a pipe whose bottom end is joined with an elbow fitting, and said elbow fitting has its outer end joined with one end of the pivotal rod having a through hole communicating with a pipe fixed between the pivotal rod and the toilet bowl for the water coming from the tank to flow into the toilet bowl for flushing and washing it.

3. The concealed toilet bowl as claimed in claim 1, wherein said toilet bowl has its through hole communicating with a Z-shaped pipe which can always store some water therein no matter if said toilet bowl may be in use position or in concealed position.

* * * * *